United States Patent [19]

Reed

[11] Patent Number: 5,062,624

[45] Date of Patent: Nov. 5, 1991

[54] RIDING CAPSULE DEVICE

[76] Inventor: Victoria K. Reed, 1778 Peck La., Cheshire, Conn. 06410

[21] Appl. No.: 922,942

[22] Filed: Oct. 24, 1986

[51] Int. Cl.[5] ..... A63G 23/00

[52] U.S. Cl. ..... 272/1 R; 272/35

[58] Field of Search ..... 272/1 R, 33 A, 56, 120, 272/115, 35, 31 B, 32, 1 C; 180/119, 125

[56] References Cited

U.S. PATENT DOCUMENTS

| | | | |
|---|---|---|---|
| Re. 13,271 | 7/1911 | Sharkey | 272/35 |
| 869,083 | 10/1907 | Hebig | 272/35 |
| 1,979,844 | 11/1934 | Rouenville | 272/33 A |
| 2,878,858 | 3/1959 | Winchester | 272/33 A |
| 3,451,673 | 6/1969 | Matson | 272/35 |
| 3,708,140 | 1/1973 | Rashis | 180/119 |
| 3,749,399 | 7/1973 | Fedor et al. | 272/32 |
| 4,045,906 | 9/1977 | Goldfarb et al. | 446/179 |
| 4,453,613 | 6/1984 | Gebelius | 180/125 |
| 4,573,938 | 2/1986 | Sassack | 446/179 |

FOREIGN PATENT DOCUMENTS

| | | | |
|---|---|---|---|
| 105200 | 4/1984 | European Pat. Off. | 272/1 R |

*Primary Examiner*—Robert A. Hafer

*Assistant Examiner*—Sam Rimell

*Attorney, Agent, or Firm*—CTC & Associates

[57] ABSTRACT

A riding capsule device comprises a capsule member and a base member. The capsule member includes a generally egg-shaped body having a convex exterior shape with a bottom configuration in the form of a convex spherical segment. The base member includes a flat bottom surface and a top configuration in the form of a concave spherical segment. The bottom convex spherical segment of the capsule member engages the top concave spherical segment of the base member, whereby the capsule member is tiltable and rotatable with respect to the base member while the base member confines the capsule to a limited horizontal location. In first and second embodiments, the radius of curvature of the convex spherical segment is the same as that of the concave engaging spherical segment while in a third embodiment, the radius of curvature of the concave spherical segment is greater than that of the convex spherical segment. The device is provided with braking means for stopping the tilting and turning action of the capsule member, whenever desired, by either a capsule member occupant or someone outside the device.

18 Claims, 3 Drawing Sheets

RIDING CAPSULE DEVICE

BACKGROUND OF THE INVENTION

The present invention relates to an amusement device, more particularly a riding capsule device including a capsule member that rolls back and forth with a person therein and more particularly to such a capsule device further including a base member that confines the capsule member to a very limited area of a floor or other horizontal surface, during rolling action.

Amusement devices that roll back and forth are known in the prior art, which is typified by the following U.S. Patents:

| U.S. Pat. No. | Date | Inventor |
|---|---|---|
| 1,395,698 | November 1, 1921 | Baum et al. |
| 1,979,844 | November 6, 1934 | Rouenville |
| 3,041,070 | June 26, 1962 | Kerstein |
| 3,380,735 | April 30, 1968 | Rigby |
| 3,477,713 | November 11, 1969 | Cudmore |
| 3,674,260 | July 4, 1972 | Loseke |
| 4,272,093 | June 9, 1981 | Filice et al. |

Baum et al. '698 discloses a combined rocking and revolving chair with a rocking base comprising a spherical segment and a revolving chair mounted on the base. A platform extends laterally from the spherical segment to limit tipping of the chair.

Rouenville '844 discloses an amusement device comprising a spherical shell, weighted elements within the shell and a table having a concave surface which holds the shell.

Kerstein '070 teaches a rocking and revolving amusement device having a weighted convex bottom.

Rigby '735 shows a rockable and rotatable device with a circumferential external flange to limit rocking action.

Cudmore '713 discloses a rocking capsule comprising a hollow, egg-shaped thin shell structure in which the center of radius of curvature of the bottom is above the center of gravity of the user so that the structure seeks a position in which the structure is upright. It is said that the capsule may be used on a hard surface such as the earth or a floor, or it may be used on a fluid surface, such as a body of water, or may be supported on sufficiently strong jets of gases, such as air.

Loseki '260 discloses a semi-spherical plaything for children to ride in. The plaything has a chamber, the bottom of which is curved so that it can be rollicked along a smooth surface. The plaything also can be pushed about by a playmate.

Filice et al. '093 discloses a self-propelled rolling toy that moves in a confined area.

An important object of the invention is to provide an improved riding capsule.

Additional objects and advantages will appear hereinafter.

SUMMARY OF THE INVENTION

A riding capsule device embodying the invention comprises a capsule member and a base member.

The capsule member includes a rigid, generally egg-shaped body having an interior configuration to accommodate an occupant and a convex exterior shape with a bottom configuration in the form of a convex spherical segment of predetermined radius of curvature.

The base member includes a flat bottom surface and a top configuration in the form of a concave spherical segment.

The capsule member engages the base member with the bottom configuration of the capsule member engaging the top configuration of the base member, this engagement serving to confine the capsule member to a very limited area of a floor or other horizontal surface on which the base member is placed.

A first disclosed embodiment of the invention is particularly suitable for use in an amusement park or other public place, such as a fastfood restaurant.

Second and third disclosed embodiments of the invention are particularly suitable for use in the home.

In the first embodiment, the radii of curvature of the bottom convex spherical segment of the capsule member and the concave spherical segment of the base member are the same, to produce a bearing engagement therebetween.

Further in the first embodiment, the concave spherical segment of the base member has a plurality of air holes in its concave spherical surface, the air holes communicating with an inlet port that is connectible to a source of air pressure, whereby the air pressure will provide an air bearing between the base member and the capsule member to enable rolling and turning action. Means is provided for automatically preventing overtilting of the capsule member. As disclosed, this means is an interruption in the convex spherical segment of the capsule member, whereby the air bearing is automatically broken if the capsule member tilts more than a predetermined number of degrees off vertical. When this occurs, the capsule member settles down in more or less a vertical position and the air bearing is re-established, so long as air continues to be blown into the inlet port by the source of air pressure.

In the second embodiment, the concave spherical segment of the base member is provided with captured balls to facilitate rolling action, in lieu of the air bearing of the first embodiment.

In the third embodiment, the radius of curvature of the bottom convex spherical segment of the capsule member is less than the radius of curvature of the concave spherical segment of the base member, so that the capsule member can tilt and turn with respect to the base member.

Each embodiment includes braking means for stopping the action of the capsule member. As disclosed, the braking means is controllable by a capsule member occupant or by someone outside the capsule device and is provided by braking members in the base member that are liftable into engagement with the convex spherical segment of the capsule member.

DESCRIPTION OF THE DRAWING

FIG. 1 illustrates a first riding capsule device 10 embodying the invention, device 10 being particularly suitable for use in an amusement park or other public place, such as a fast food restaurant.

Device 10 comprises a capsule member 12 and a base member 14.

Capsule member 12 is a rigid, generally egg-shaped body having an interior configuration to accommodate at least one occupant and a convex exterior shape with a bottom configuration in the form of a convex spherical segment 16 of predetermined radius of curvature.

Capsule member 12 also has an opening 17 in the upper portion, whereby users can get in and out of capsule member 12.

Figure 1:
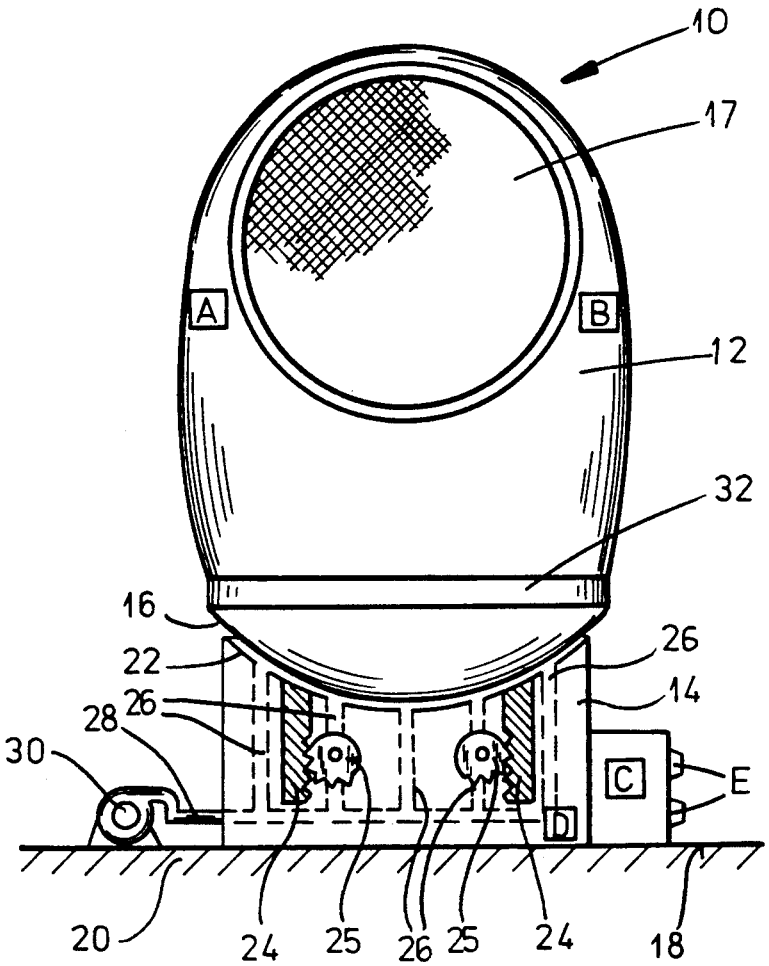
FIG. 1 is front view of a first preferred riding capsule device embodying the invention, comprising a capsule member shown in elevation and a base member shown in axial section.
Figure 2:
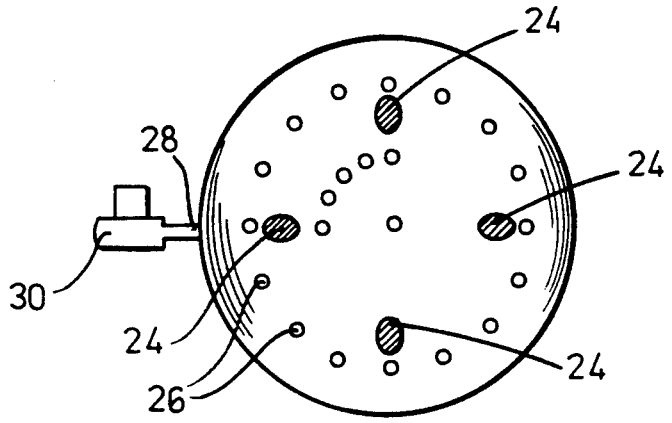
FIG. 2 is a plan view of the base member of FIG. 1.

Base member 14, which is also shown in plan view in FIG. 2, includes a flat bottom surface 18 shown in FIG. 1 resting in a fixed position on a horizontal floor 20, and a top configuration in the form of a concave spherical segment 22.

Capsule member 12 engages base member 14 with spherical segment 16 engaging spherical segment 22. This engagement serves to confine capsule member 12 to a very limited area of floor 20.

The radius of curvature of segment 16 is the same as that of segment 22, whereby capsule member 12 is in bearing engagement with base member 14 and can tilt back and forth and rotate with respect thereto.

Base member 14 further has a plurality of air holes 26 in open communication with the surface of concave spherical segment 22. Air holes 26 communicate with an inlet port 28 that is connectible to a blower 30 or other source of air pressure, whereby the air pressure will provide an air bearing between base member 14 and capsule member 12, further to enhance tilting and rotary movement of capsule member 12.

Means is provided for automatically preventing overtilting of capsule member 12. As shown in FIG. 1, this means is an interruption of spherical segment 16, the interruption provided by a cylindrical external surface 32, whereby the air bearing is automatically broken if capsule member 12 tilts more than a predetermined number of degrees off vertical and a portion of cylindrical surface 32 enters concave spherical segment 22 of base member 14. When this occurs, capsule member 12 settles down in more or less a vertical position, re-establishing the air bearing and enabling resumed operation, so long as air continues to be blown into inlet port 28 by blower 30.

Braking means is provided for stopping the tilting and turning action of capsule member 12, whenever desired by either a capsule member occupant or someone outside the device. As shown, the braking means includes braking members 24 that are carried by base member 14 and are movable between retracted positions in which they do not protrude above concave spherical segment 22, as illustrated, and raised positions in which they protrude thereabove and engage convex spherical segment 16 and lift the same away from concave spherical segment 22, immobilizing capsule member 12. Braking members 24 have teeth along one side and the braking means further includes a gear 25 associated with each braking member 24 and having teeth meshing with the teeth on its associated member 24. Each member 24 and its associated gear 25 form a rack and pinion. Gears 25 are rotatable but otherwise are stationary. The braking means further comprises a low power fixed frequency limited range battery powered radio transmitting device, such as an FM transmitter A located within capsule member 12, an on-off interlock switch B, also located within capsule member 12, and more particularly on a seat belt (not shown) or hand holds (not shown), radio receiving device capable of receiving transmissions from the radio transmitting device, such as an external FM receiver C fixed at the same frequency as transmitting device A, actuation mechanism D located within base member 14 and external control switches E. Actuation mechanism D is controlled by receiving a signal from transmitting device A, initiated by interlock switch B, or from one of external switches E. Upon receipt of such signal, an electric motor (not shown) causes gears 25 to rotate, as by a geared lever (not shown), thus raising braking members 24 into engagement with convex spherical segment 16 to lift the same away from concave spherical segment 22, thus immobilizing capsule member 12 as stated above. When the other of external switches E is pushed, gears 25 are rotated in the opposite direction and braking members 24 are retracted, thus bringing about re-engagement of convex spherical segment 16 and concave spherical segment 22.

Figure 3:
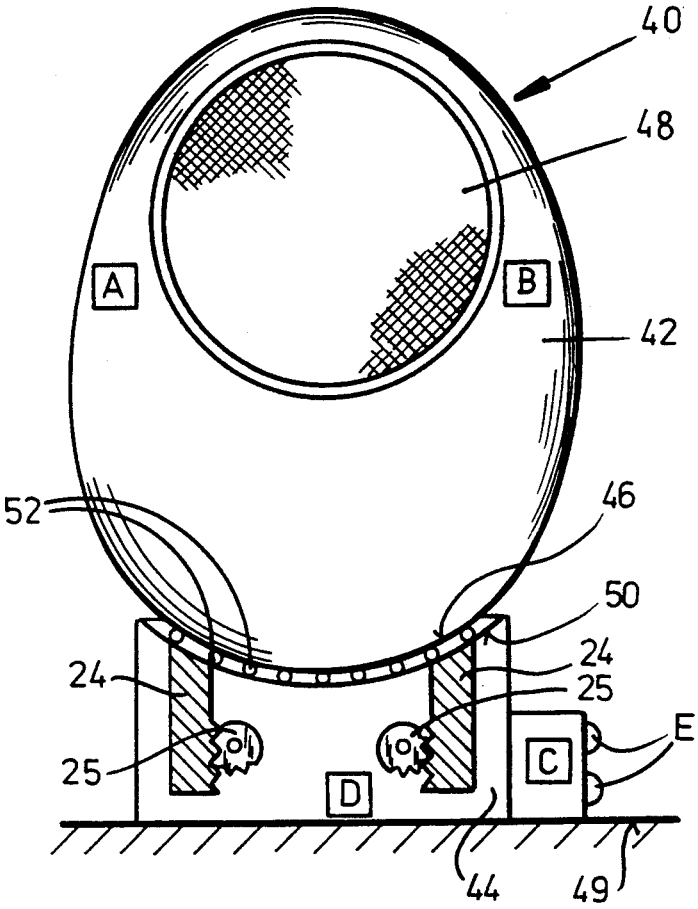
FIG. 3 is a front view of a second preferred riding capsule device embodying the invention, comprising a capsule member shown in elevation and a base member shown in axial section.
Figure 4:
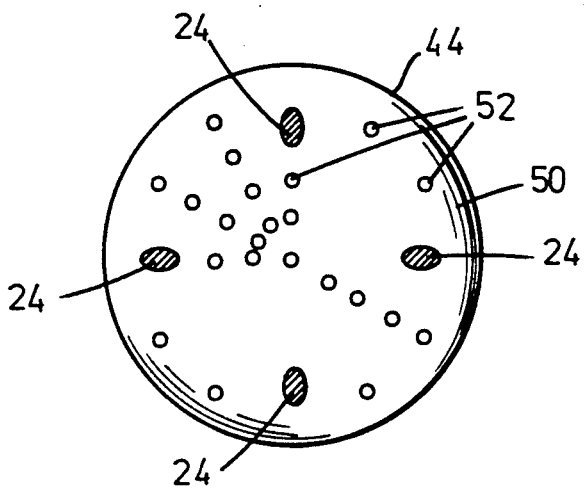
FIG. 4 is a plan view of the base member of FIG. 3.

FIG. 3 shows a second riding capsule device 40 embodying the invention. Device 40 includes a capsule member 42 and a base member 44, the latter also being shown in FIG. 4.

Capsule member 42 is very similar to capsule member 12, having an exterior configuration including at its bottom a convex spherical segment 46 of predetermined radius of curvature.

Member 42 also has an opening 48 in its upper portion, providing ingress and egress.

Base member 44, shown on a horizontal surface 49, has a top configuration in the form of a concave spherical segment 50, the surface of which is provided with captured balls 52 that define a concave spherical surface having a radius of curvature that is the same as the radius of curvature of convex spherical segment 46 of capsule member 42, which is supported by captured balls 52 with that concave spherical surface coincident with the convex segment of member 42. Thus, the radius of curvature of concave spherical segment 50 is effectively the radius of curvature of the concave spherical surface defined by captured balls 52.

Captured balls 52 facilitate the tilting and rotary action of capsule member 42 with respect to base member 44.

Like capsule device 10, capsule device 40 is provided with braking means for stopping the tilting and turning action of capsule member 42, whenever desired by either a capsule member occupant or someone outside the device. The braking means of device 40 is the same as that of device 10, and functions in the same way. For completeness of description, it is here repeated that the braking means of device 40 includes braking members 24, gears 25, transmitting device A, on-off interlock switch B, receiving device C, actuation mechanism D and external control switches E.

Figure 5:
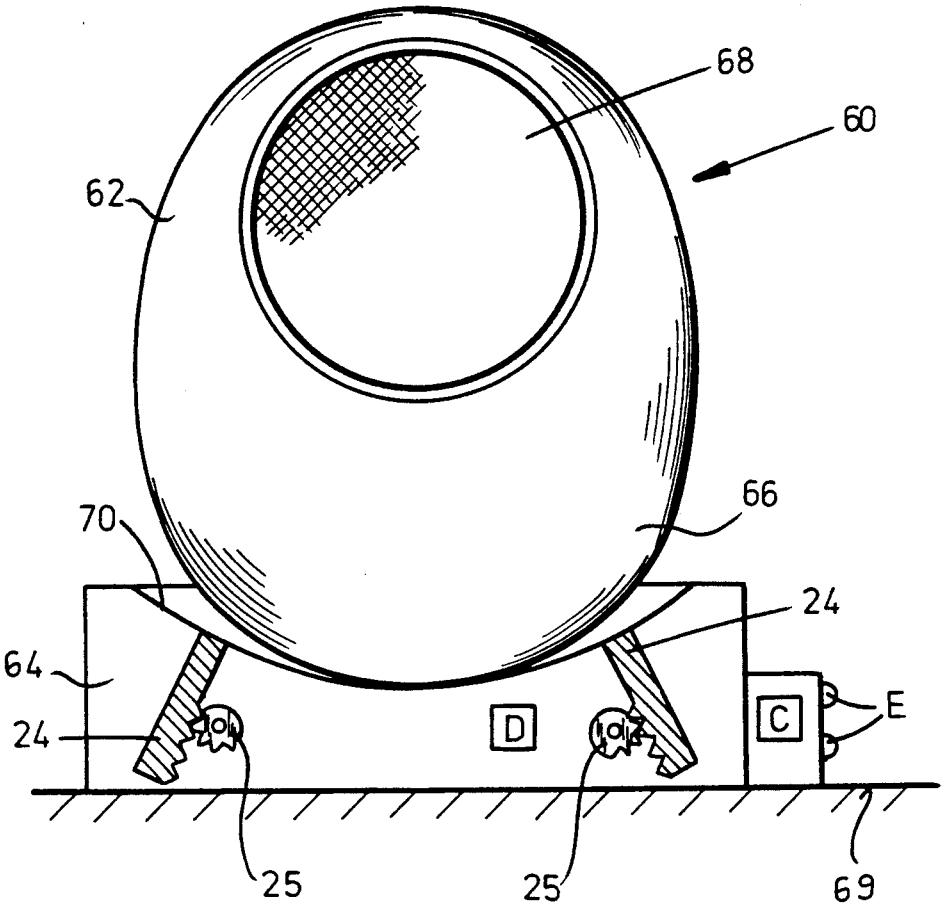
FIG. 5 is a front view of a third preferred riding capsule embodying the invention, comprising a capsule member shown in elevation and a base member shown in axial section.
Figure 6:
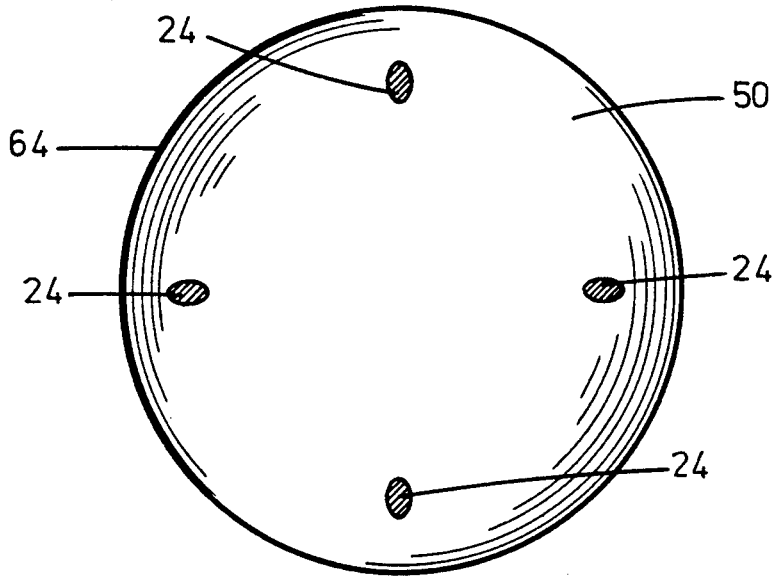
FIG. 6 is a plan view of the base member of FIG. 5.

FIG. 5 shows a third riding capsule device 60 embodying the invention. Device 60 includes a capsule member 62 and a base member 64, the latter being also shown in FIG. 6.

Capsule member 62 is similar to capsule member 12, having an exterior configuration including a bottom configuration in the form of a convex spherical segment 66 of predetermined radius of curvature.

Member 62 also has an opening 68 in its upper portion, providing ingress and egress.

Base member 64, shown on a horizontal surface 69, has a top configuration in the form of a concave spherical segment 70 of predetermined radius of curvature that is greater than the predetermined radius of curvature of convex spherical segment 66 of capsule member 62.

By virtue of the engagement of spherical segments 66 and 70, capsule member 62 can tilt and rotate, under the impetus of its occupant(s), with respect to base member 64, while confined thereby to a limited horizontal location.

Like capsule device 10, capsule device 60 is provided with braking means for stopping the tilting and turning action of capsule member 62, whenever desired by either a capsule member occupant or someone outside the device. The braking means of device 60 is the same as that of device 10, and functions in the same way. For completeness of description, it is here repeated that the braking means of device 60 includes braking members 24, gears 25, transmitting device A, on-off interlock switch B, receiving device C, actuation mechanism D and external control switches E.

The invention well attains the stated objects and advantages and others.

The disclosed details are exemplary only and are not to be taken as limitations on the invention except as those details are included in the appended claims.

What is claimed is:

1. A riding capsule device comprising a capsule member and a base member, said capsule member including a generally egg-shaped body having a convex exterior shape with a bottom configuration in the form of a convex spherical segment, said base member having a flat bottom surface for stationary placement on a horizontal surface and a top configuration in the form of a concave spherical segment, said spherical segments engaging each other so that said capsule member can tilt and rotate with respect to said base member, under the impetus of an occupant of said capsule member, while confined thereby to a limited horizontal location.

2. A device according to claim 1 wherein the radius of curvature of said convex spherical segment is the same as that of said concave spherical segment.

3. A device according to claim 2 wherein said base member further has a plurality of air holes in open communication with the surface of said concave spherical segment and an inlet port in communication with said air holes and connectible to a source of air pressure, to provide an air bearing between said base member and said capsule member.

4. A device according to claim 3 further comprising means for preventing overtilting of said capsule member.

5. A device according to claim 4 wherein said means is automatically activated to break said air bearing.

6. A device according to claim 5 wherein said means is an interruption of said convex spherical segment.

7. A device according to claim 6 wherein said capsule member has a cylindrical surface terminating said convex spherical segment and providing said interruption and said air bearing is terminated when a portion of said cylindrical surface enters said concave spherical segment.

8. A device according to claim 2 wherein said concave spherical segment is provided with captured balls to facilitate the action of said capsule member, said captured balls defining a concave spherical surface the radius of curvature of which is the effective radius of curvature of said concave spherical segment.

9. A device according to claim 1 wherein the radius of curvature of said concave spherical segment is greater than the radius of curvature of said convex spherical segment.

10. A device according to claim 1 further comprising braking means for stopping the tilting and turning action of said capsule member.

11. A device according to claim 10 wherein said braking means is controllable by an occupant of said capsule member or by someone outside the device.

12. A device according to claim 10 wherein said braking means includes braking members carried by said base member and movable between retracted positions in which they do not protrude above said concave spherical segment and raised positions in which they protrude thereabove and engage said convex spherical segment to lift same away from said concave spherical segment and immobilize said capsule member.

13. A device according to claim 12 wherein each said braking member has teeth along one side thereof and said braking means further includes, associated with each said braking member, a gear having teeth meshing with the teeth of its associated said braking member, said gears being rotatable about their axes but otherwise stationary.

14. A device according to claim 13 wherein said braking means further includes a radio transmitting device within said capsule member, an on-off interlock switch within said capsule member and operable by an occupant of said capsule member, a radio receiving device external of said capsule member and capable of receiving transmissions from said transmitting device, actuation mechanism, external control switches, and an electric motor for rotating said gears to move said braking members upon receipt of a signal from said transmitter, initiated by said interlock switch or one of said external switches.

15. A riding capsule device comprising a capsule member and a base member, said capsule member including a generally egg-shaped body having a convex exterior shape with a bottom configuration in the form of a convex spherical segment, said base member having a flat bottom surface for placement on a horizontal surface and a top configuration in the form of a concave shperical segment, said spherical segments engaging each other so that said capsule member can tilt and rotate with respect to said base member, under the impetus of an occupant of said capsule member, while confined thereby to a limited horizontal location, wherein the radius of curvature of said convex spherical segment is the same as that of said concave spherical segment, said base member having a plurality of air holes in open communication with the surface of said concave spherical segment and an inlet port in communication with said air holes and connectible to a source of air pressure, to provide an air bearing between said base member and said capsule member, said device further comprising means for preventing overtilting of said capsule member, said means being automatically activated to break said air bearing, and wherein said means is an interruption of said convex spherical segment.

16. A device according to claim 15 wherein said capsule member has a cylindrical surface terminating said convex spherical segment and providing said interruption and said air bearing is terminated when a portion of said cylinderical surface enters said concave spherical segment.

17. A riding capsule device comprising a capsule member and a base member, said capsule member including a generally egg-shaped body having a convex exterior shape with a bottom configuration in the form of a convex spherical segment, said base member having a flat bottom surface for placement on a horizontal surface and a top configuration in the form of a concave spherical segment, said spherical segments engaging each other so that said capsule member can tilt and rotate with respect to said base member, under the impetus of an occupant of said capsule member, while confined thereby to a limited horizontal location, said device further comprising braking means for stopping the tilting and turning action of said capsule member, said braking means including braking members carried by said base member and movable between retracted positions in which they do not protrude above said concave spherical segment and raised positions in which they protrude thereabove and engage said convex spherical segment to lift same away from said concave spherical segment and immobilize said capsule member, wherein each said braking member has teeth along one side thereof and said braking means further includes, associated with each said braking member, a gear having teeth meshing with the teeth of its associated said braking member, said gears being rotatable about their axes but otherwise stationary.

18. A device according to claim 17 wherein said braking means further includes a radio transmitting device within said capsule member, an on-off interlock switch within said capsule member and operable by an occupant of said capsule member, a radio receiving device external of said capsule member and capable of receiving transmissions from said transmitting device, actuation mechanism, external control switches, and an electric motor for rotating said gears to move said braking members upon receipt of a signal from said transmitter, initiated by said interlock switch or one of said external switches.

* * * * *